United States Patent [19]

Hurtig

[11] Patent Number: 5,050,464

[45] Date of Patent: Sep. 24, 1991

[54] MULTI-SURFACE WRENCH

[75] Inventor: Carl R. Hurtig, Cohasset, Mass.

[73] Assignee: Encor Limited, Cohasset, Mass.

[21] Appl. No.: 581,072

[22] Filed: Sep. 7, 1990

Related U.S. Application Data

[63] Continuation of Ser. No. 258,193, Oct. 14, 1988, abandoned.

[51] Int. Cl.[5] ..... B25B 13/28

[52] U.S. Cl. ..... 81/90.1; 81/90.3; 81/91.3; 81/97

[58] Field of Search ..... 81/90.1, 90.2, 90.3, 81/90.9, 91.3, 92, 94, 186, 97, 99, 126

[56] References Cited

U.S. PATENT DOCUMENTS

| | | | |
|---|---|---|---|
| 714,364 | 11/1902 | Cogan . | |
| 1,359,660 | 11/1920 | Blair . | |
| 1,386,136 | 8/1921 | Sibbald . | |
| 1,573,409 | 11/1921 | Lynch et al. | 81/90.1 |
| 2,210,274 | 8/1940 | Becklin | 81/91 |
| 2,476,369 | 10/1947 | Gutowski | 81/91 |
| 2,706,923 | 4/1955 | Kvaerne | 81/90.1 |
| 2,762,249 | 9/1956 | Sosa | 81/90.1 |
| 2,814,225 | 11/1957 | Mann | 81/90.3 |
| 3,044,335 | 7/1962 | Keranen | 81/126 X |
| 3,309,949 | 3/1967 | Neff | 81/186 X |
| 4,437,364 | 3/1984 | Martinmaas | 81/179 |
| 4,441,387 | 4/1984 | Hendricks | 81/61 |
| 4,499,797 | 2/1985 | Wilson | 81/367 |
| 4,602,533 | 7/1986 | Dunn | 81/134 |
| 4,616,534 | 10/1986 | Park et al. | 81/99 |
| 4,616,536 | 10/1986 | Knebel et al. | 81/128 |
| 4,706,528 | 11/1987 | Inoue | 81/179 |
| 4,773,287 | 9/1988 | Clarke | 81/97 X |
| 4,913,011 | 4/1990 | Ma | 81/90.1 |

FOREIGN PATENT DOCUMENTS

| | | | |
|---|---|---|---|
| 3106510 | 9/1982 | Fed. Rep. of Germany | 81/90.1 |

*Primary Examiner*—D. S. Meislin

*Attorney, Agent, or Firm*—Weingarten, Schurgin, Gagnebin & Hayes

[57] ABSTRACT

A multi-surface wrench is provided which is automatically self-adjustable to capture nuts or bolts of differing sizes over a predetermined useful range. The multi-surface wrench is self-camming upon application of a torque producing or turning force and is ratchetable upon application of a ratcheting force. The multi-surface wrench includes a handle assebmly having a biasing spring disposed therein and a wrench head assembly secured to the handle assembly. The wrench head assembly includes a body member pivotally attached to the handle assembly by a first pivot pin and a hook member pivotally attached to the handle assembly by a second pivot pin. The biasing spring coacts with the hook member for automatic self-adjustment of the wrench head assembly to capture nuts of differing sizes. A turning force applied to the handle assembly causes coaction of the body and hook members to exert locking forces against the captured nut and to create a self-tightening action between the wrench head assembly and the captured nut. A ratcheting force applied to the handle assembly causes a ratcheting coaction between the body and hook members such that the wrench head assembly freely rotates about the nut for subsequent recapture with an acoustic feedback signal and further application of turning forces.

7 Claims, 9 Drawing Sheets

X
INCHES
Y
INCHES
Z
Y
X
$\frac{L_H}{L_T}$ = .9
$\frac{L_H}{L_T}$ = .857
$\frac{L_H}{L_T}$ = .8
132
134

MULTI-SURFACE WRENCH

This application is a continuation of application Ser. No. 07/258,193, filed Oct. 14, 1988, now abandoned.

FIELD OF THE INVENTION

The present invention relates generally to open-ended, adjustable wrenches, and more particularly to a multi-surface wrench which is automatically self-adjustable to capture different sized nuts or bolts within a predetermined range, which is self camming upon the application of a turning force, and which is ratchetable upon application of a ratcheting force.

BACKGROUND OF THE INVENTION

With the advent of increasingly complex and compact mechanical equipment, a need has developed for a wrench that may be utilized with such equipment. The wrench should be capable of engaging nuts or bolts located in confined spaces, i.e., a wrench head assembly having narrow lateral dimensions, and readily usable in confined spaces. At the same time, however, the wrench head assembly should have sufficient structural integrity for the application of high turning forces to the nut. The wrench should also be ratchetable. The wrench should also be capable of contacting the nut at more than two contact zones such that high torques may be more evenly distributed on the nut faces. Preferably, the wrench should be useable over a wide range of nut sizes.

Open-ended wrenches have greater utility in confined area applications as opposed to closed-ended wrenches such as box or socket type wrenches. Often it is extremely difficult, if not impossible, in confined area applications to provide the necessary transverse movement required by box or socket type wrenches to initially capture the nut. It will also be appreciated that box or socket type wrenches typically cannot be utilized on nuts associated with piping or tubing applications.

Adjustable wrenches are well known to those skilled in the art and to the laymen. An adjustable wrench has two contact zones and embodies certain features which may render it impractical for use in confined area applications. Most prior art adjustable wrenches utilize a manual adjustment mechanism such as a worm mechanism to open or close the jaws of the wrench In confined area applications, it may be awkward to activate the manual adjustment mechanism, it may be difficult to determine whether the worm mechanism is being properly activated, and it may be difficult to ascertain whether the wrench jaws have properly captured the nut.

In addition, open-ended adjustable wrenches apply torque to the nut at only two contact zones. Due to misadjustment or slippage between the nut faces and the wrench jaws, the moment arms of the torque applied to the nut may be reduced. The reduced moment arms necessitate the application of a higher turning force to ensure that a predetermined torque is applied to the nut. The increased turning force is often sufficient to cause damage to the nuts which reduces the moment arm even more. Damaging of nuts or operator injury are prime concerns in the use of adjustable wrenches, especially for applications involving plastic or nonferrous nuts or bolt heads. In addition, the application of higher turning forces requires thicker wrench head walls to withstand the higher torque forces, and thicker wrench head walls further limit the utility of adjustable wrenches in confined area applications.

Open-ended ratchet wrenches are also known to those skilled in the art and to the laymen, as exemplarily illustrated in U.S. Pat. No. 4,441,387. These wrenches are adjustable only in the sense that circular wrench discs of varying dimensions may be utilized to capture nuts or bolt heads of differing sizes. It will be appreciated, therefore, that these wrenches are limited inasmuch as the wrench must be removed from the work area to replace the circular wrench disc each time a nut of different size is to be torqued. Further, these ratchet wrenches are not self tightening. In addition, open-ended ratchet wrenches of this type are not immediately functional upon capture of the nut or bolt head by the circular wrench disc. Rather, a cam pin must be manually engaged prior to torqueing operation of the wrench. Manual engagement of the cam pin may be difficult in confined area applications. Additionally, these open-ended ratchet wrenches are relatively complex mechanically, thereby decreasing the reliability thereof and increasing the cost and time involved in fabrication and assemblage thereof.

SUMMARY OF THE INVENTION

A multi-surface wrench is provided which is self-adjustable to capture nuts or bolts of differing sizes over a predetermined useful range, which is self camming to transmit an applied turning force as locking forces to the captured nut, and which is ratchetable upon the application of a ratcheting force. The multi-surface wrench according to the present invention includes a handle assembly and a wrench head assembly including a body member rotatably attached to the handle assembly by means of a first pivot pin and a hook member rotatably attached to the handle assembly by means of a second pivot pin.

The hook member and the body member of the wrench head assembly each include at least one planar contacting surface for contacting and applying torque to nuts of differing sizes. The hook and body members in combination define a wrench opening to permit the capture of a nut.

The handle assembly includes an internally mounted biasing spring which coacts with the hook member. To capture a particular nut, the wrench opening of the wrench head assembly is pushed onto the nut with a small capture force. The hook member rotates about the second pivot pin against the force exerted by the biasing spring and may cause a rotation of the body member so that the nut passes through the wrench opening and is captured.

One embodiment of the present invention is a three-surface wrench which comprises a wrench head assembly having three planar contacting surfaces, two on the body member and one on the hook member, which contact corresponding faces of the nut. Each contact surface is approximately 120° from adjacent contact surfaces.

A three-surface wrench is disclosed that has a normal range of approximately 1.22. With this range and a mid-range nut width of approximately 0.75 inches, a single three-surface wrench is capable of capturing seven different standard-sized nuts, including four American sizes and three metric sizes.

Another embodiment of the present invention is a four-surface wrench which comprises a wrench head assembly having four planar contacting surfaces, two on the body member and two on the hook member, which contact corresponding faces of the nut. In this embodiment, the corresponding contact surfaces comprise pairs of adjacent faces of the nut, with diametrically opposed noncontacted faces of the nut between the pairs.

A four-surface wrench is disclosed that has a normal range of 1.33. With this range and a mid-range nut width of approximately 0.725 inches, a single four-surface wrench is capable of capturing eleven different standard-sized nuts, including five American sizes and six metric sizes.

The hook member and the body member are pivotally attached to the handle assembly. A turning force applied to the handle assembly causes the hook member and the body member to exert locking forces on the captured nut. These locking forces create a continuous self-tightening or self-camming action between the wrench head assembly and the captured nut. The larger the turning force applied to the handle assembly, the larger the locking forces applied on the captured nut by means of the body member and the hook member.

The multi-surface wrench according to the present invention is unconditionally stable in that this self-camming or self-tightening action exists regardless of the point of application of the turning force to the handle assembly. The multi-surface wrench of the present invention will not "unlock", that is the wrench head assembly will not disengage from the nut, if the turning force is applied in close proximity to the wrench head assembly.

The multi-surface wrench of the present invention is ratchetable such that a ratcheting force applied to the handle assembly will cause relative rotation of the wrench head assembly about the nut through an angle of approximately 60 degrees or multiples thereof. After the multi-surface wrench has been ratcheted about the nut, the biasing spring exerts a force against the hook member causing the wrench head assembly to recapture the nut such that a subsequent turning force may be applied to the handle assembly.

As the wrench head assembly is opened to permit ratcheting, the torsional energy in the bias spring is increased. The design of the multi-surface wrench is such that when the tip of the hook member has cleared the corner of the nut, the torsional energy in the bias spring causes the hook member to snap onto the nut with an audible click. The audible click serves as an acoustic feedback signal to indicate that the 60 degree rotation or multiples thereof has been achieved and that the ratcheting force may be terminated. A small degree of training is required to perfect this technique.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1B:
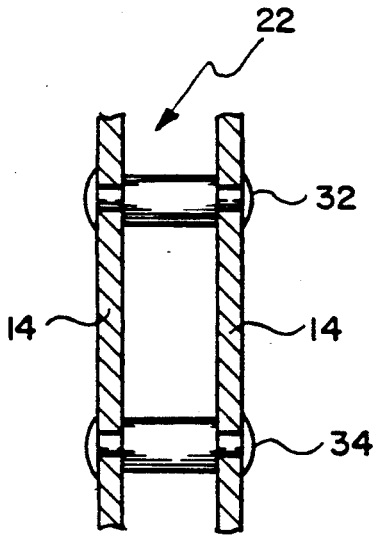
FIGS. 1B, 1C are cross section views of the three-surface wrench of FIG. 1A taken along lines B—B, C—C, respectively.

Referring now to the drawings wherein like numerals designate corresponding or similar elements throughout the several views, FIGS. 1–3 illustrate embodiments of a multi-surface wrench. The multi-surface wrenches shown in FIGS. 1–3 represent a three-surface wrench 10 which includes a handle assembly 12 and a wrench head assembly 30. As will be discussed hereinbelow in greater detail, the wrench head assembly 30 of the three-surface wrench 10 contacts a hex nut on three different contact surfaces, each contact surface being spaced approximately 120° from adjacent contact surfaces.

As used herein, the phrase contact surfaces defines those portions of the hex nut contacted by the wrench head assembly. In the practical world where very tight dimensional tolerances are costly to produce, the tolerances of the wrench elements can be relaxed and the contact of the wrench and the nut surfaces can still be achieved at the three critical corners, 120 degrees apart, but with one or more contacts becoming a line contact. This arrangement can be achieved with only very minor changes in the ultimate strength of the wrench. This condition of line contact may also occur under very heavy loads when the elements of the wrench or the nut undergo elastic deformation.

Figure 1C:
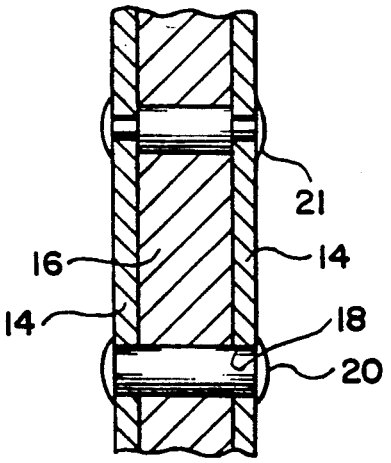
Figure 1A:
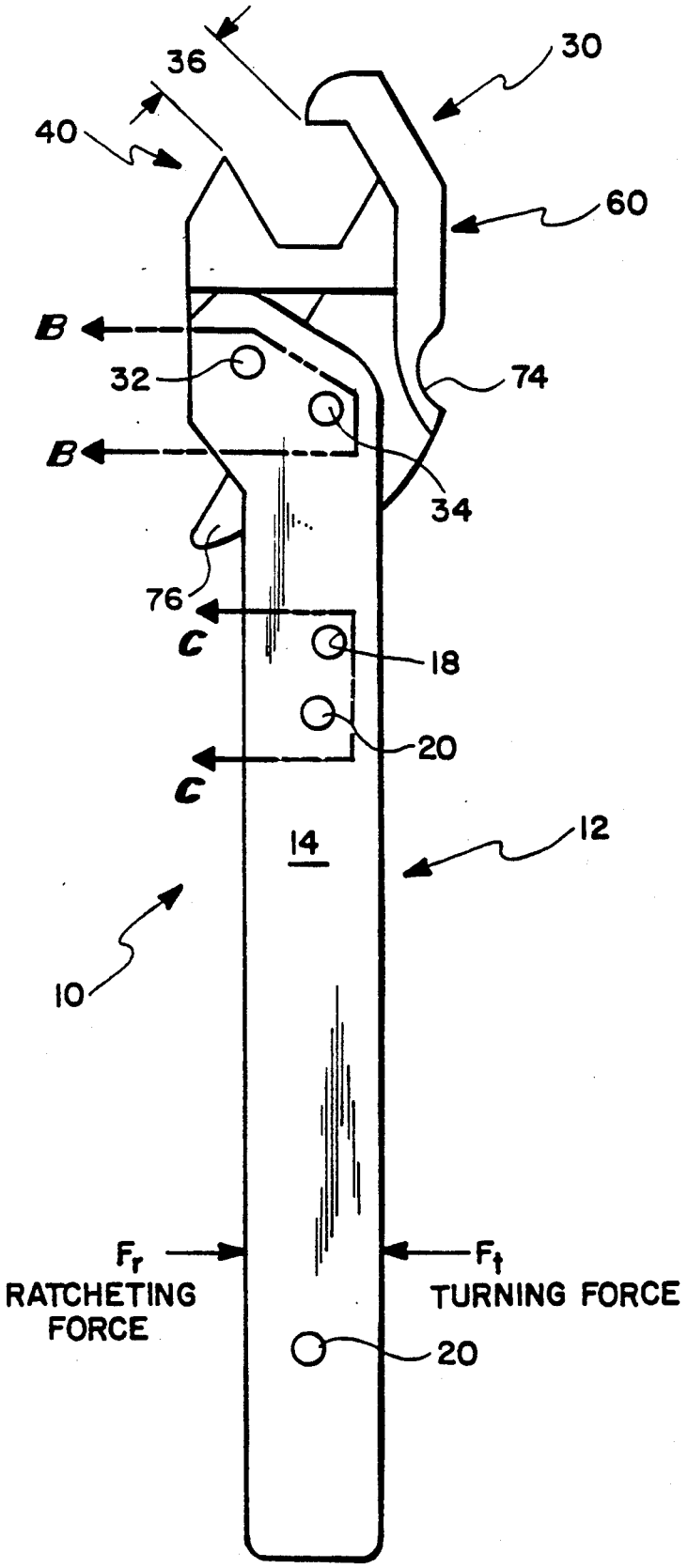
FIG. 1A is a plan view of one embodiment of a three-surface wrench according to the present invention.

Working models of the three-surface wrench 10 of FIG. 1A have been built with a range of 1.22. As used herein, the range is defined as the ratio of the maximum nut width to minimum nut width. For example, the three-surface wrench 10 of FIG. 1A has a range of 1.22, from a minimum nut width of approximately 0.672 inches to a maximum nut width of approximately 0.820 inches. This range encompasses seven different nut sizes, including four standard American nut sizes of 11/16, 12/16, 25/32 and 13/16 and three intermediate standard metric sizes.

The handle assembly 12 exemplarily illustrated in FIGS. 1–3 includes two external members 14, 14 and a spacing member 16 interposed therebetween. The external members 14, 14 and the spacing member 16 have holes 18 formed therethrough and into which pins 20, 21, 32, 34 are inserted, see FIGS. 1B, 1C, to assemble the handle assembly 12. The spacing member 16 has a length less than the external members 14, 14 such that a wrench head assembly slot 22 is formed between the external members 14, 14 at one end of the handle assembly 12, as shown in FIG. 1B.

It is to be understood that alternative embodiments are possible for the handle assembly. For example, the handle assembly can be formed from two elements which are mirror images or even as a single element with an integral wrench head assembly slot.

Figure 2A:
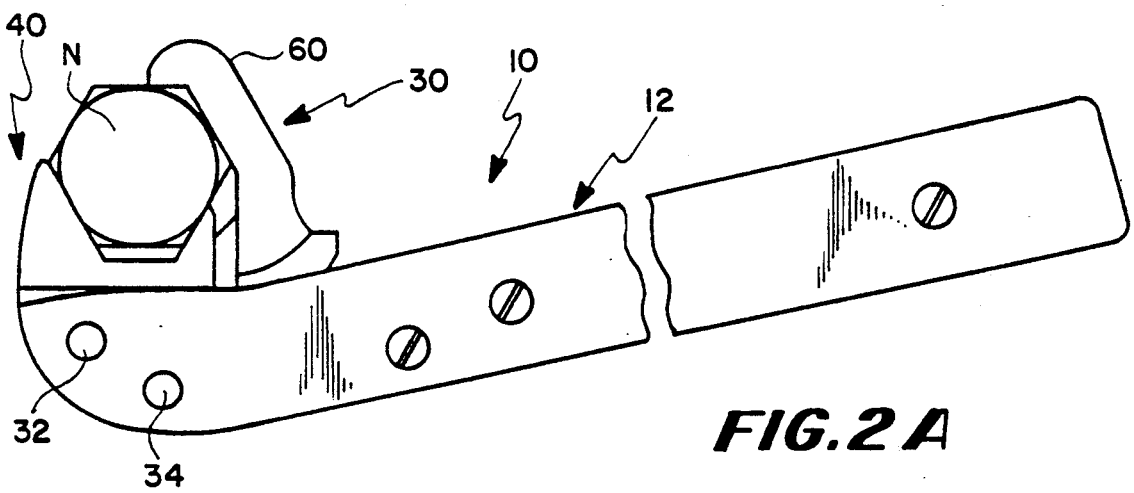
FIGS. 2A, 2B, 2C are plan views of another embodiment of a three-surface wrench illustrating the capture of three different nut sizes.
Figure 2B:
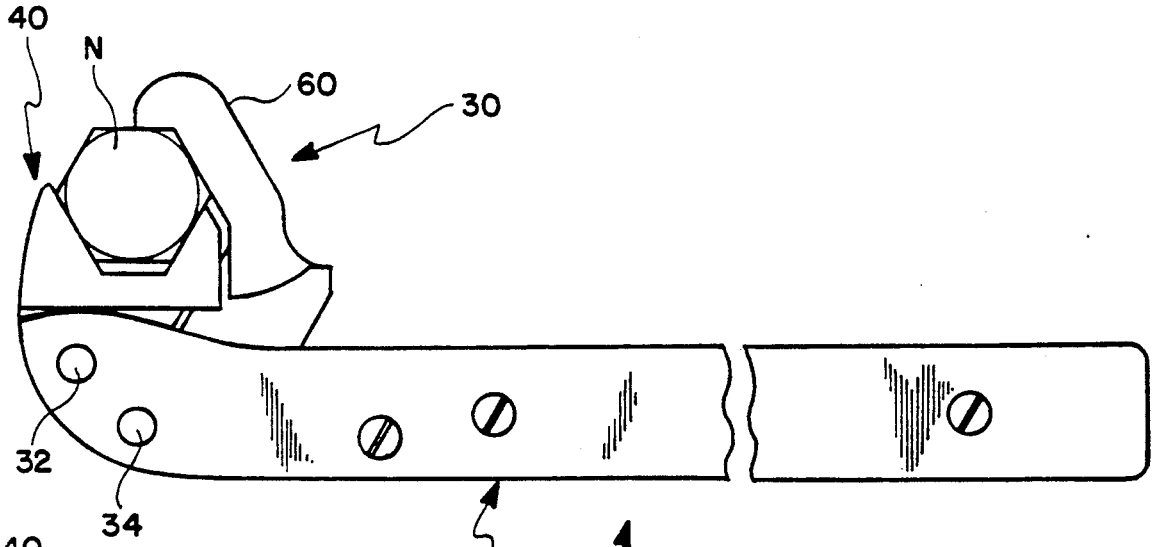
Figure 2C:
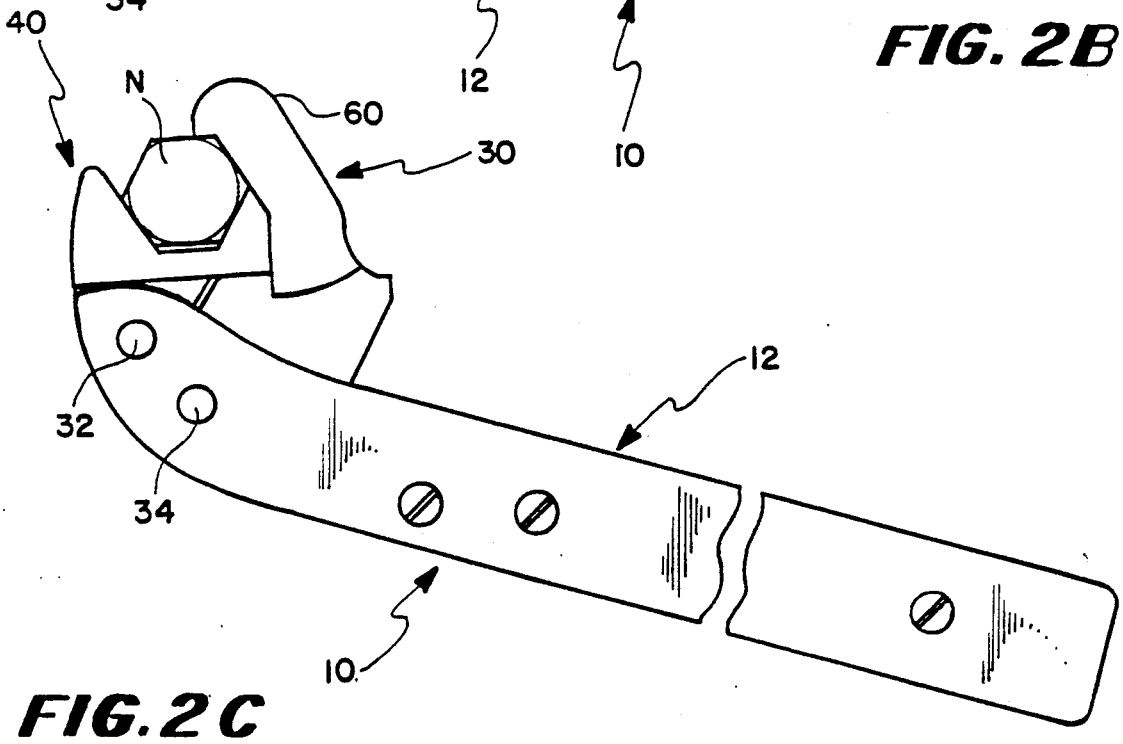

The axis of the handle assembly 12 of FIG. 1A is generally collinear with the center of nested nuts and is defined as an in-line wrench. The axis of the handle assembly 12 of FIGS. 2A, 2B, 2C is generally perpendicular with the center of nested nuts and is defined as a perpendicular wrench. The multi-surface wrench can also accommodate handle assemblies having axes disposed at any angle between collinear and perpendicular.

While the configuration of the handle assembly may be based upon marketing and/or utility considerations, any of the aforedescribed handle assembly configurations have essentially the same mechanical strength. The perpendicular configuration, however, does present some advantages, as discussed hereinbelow.

The handle assembly 12 has a biasing spring 26 internally mounted therein. As exemplarily illustrated in FIG. 3A, a spring receiving slot 24 is formed in the spacing member 16. The biasing spring 26 is disposed within the spring receiving slot 24 and mounted on a pin 21. One arm 26A of the biasing spring 26 contacts a hook member 60 of the wrench head assembly 30 while the other arm 26B contacts a portion of the handle assembly 12 such as a sidewall of the spring receiving slot 24.

The wrench head assembly 30 includes a body member 40 and a hook member 60. The body member 40 includes a jaw portion 42 and a tang portion 44. The hook member 60 likewise includes a jaw portion 62 and a tang portion 64. Pivot holes 46, 66 are formed in the tang portions 44, 64 of the body member 40 and the hook member 60, respectively.

The tang portion 44 of the body member 40 and the tang portion 64 of the hook member 60 are sized to fit within the wrench head assembly slot 22 shown in FIG. 1B. Referring to FIGS. 1A, 1B, the body member 40 is pivotally attached to the handle assembly 12 by means of a first pivot pin 32 disposed through the pivot hole 46 and corresponding holes in the external members 14, 14. In a similar manner, the hook member 60 is pivotally attached to the handle assembly 12 by means of a second pivot pin 34 disposed through the pivot hole 66 and corresponding holes in the external members 14, 14.

Figure 3A:
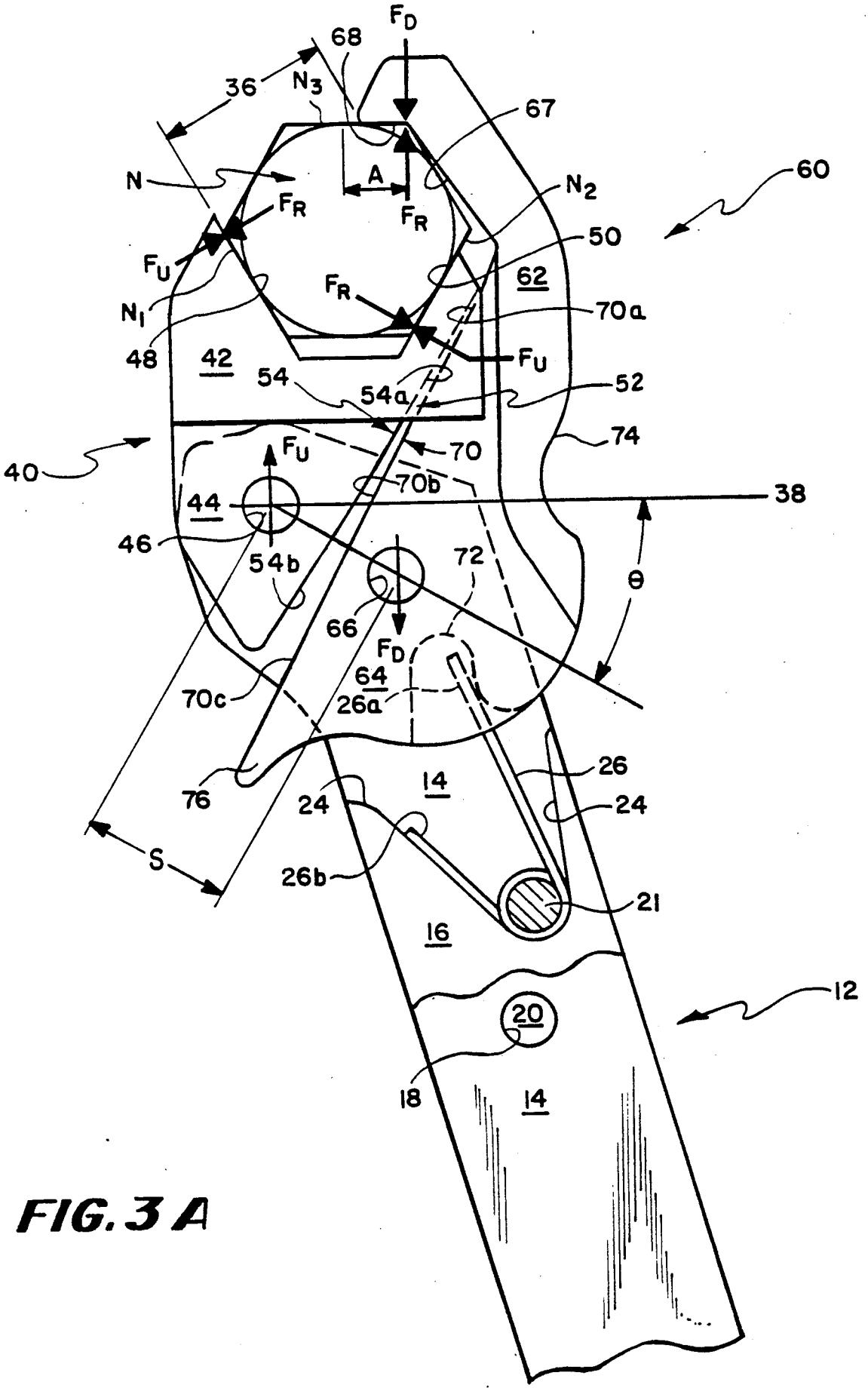
FIG. 3A is a partial sectional view of the three-surface wrench of FIG. 1A with a medium-sized nut captured within the wrench head assembly.

With respect to FIG. 3A, the jaw portion 42 includes a first contacting surface 48 and a second contacting surface 50. A slot 52 is formed in the jaw portion 42 adjacent the hook member 60 for slidably receiving the tang portion 64 of the hook member 60. The tang portion 44 of the body member 40 includes a confronting surface 54.

The jaw portion 62 of the hook member 60 includes a contacting surface 68. The tang portion 64 of the hook member 60 includes a confronting surface 70 and a surface 72 which engages the arm 26A of the biasing spring 26.

The jaw portion 42 of the body member 40 and the jaw portion 62 of the hook member 60 in combination define a wrench opening 36.

To capture a particular nut, the wrench opening 36 is placed in contact with the nut. A small capture force is exerted on the handle assembly 12 in the direction of the wrench head assembly 30. This capture force causes the hook member 60 to rotate about the second pivot pin 34 against the force exerted by the biasing spring 26 such that the wrench opening 36 is enlarged to accommodate the particular width of the nut. The rotation of the hook member 60 may cause movement of the body member 40. The nut slides through the enlarged wrench opening 36 and is subsequently captured by the planar contacting surfaces 48, 50, 68 of the jaw portions 42, 62.

As the nut passes into the wrench head assembly 30, the torsional energy stored in the biasing spring 26 causes the hook member 60 to snap over a corner of the nut. As the hook member 60 snaps over the corner of the nut an audible click is generated The audible click provides an acoustic feedback signal to the operator to terminate the capture force. This feature is particularly useful in limited space applications where it is not possible to directly observe the nut capture process.

Optionally, the hook member 60 may include means for manually enlarging the wrench opening 36. As exemplarily illustrated in FIGS. 1A, 3A, this may include a finger depression 74 formed in the jaw portion 62 and/or a thumb projection 76 formed on the tang portion 64 to extend outwardly beyond the handle assembly 12.

To produce torque, a turning force $F_t$ is applied to the handle assembly 12 as shown in FIG. 1A. The force $F_t$ is transmitted as an upward force $F_U$ through the first pivot pin 32 to the body member 40. The force $F_t$ is also transmitted as a downward force $F_D$, which is equal and parallel to the upward force $F_U$, through the second pivot pin 34 to the hook member 60. The force $F_D$ causes the surface 68, in contact with nut face $N_3$ of a nut N, to exert a locking force $F_D$ thereagainst. Since both the body member 40 and the hook member 60 are freely rotatable on the first and second pivot pins 32, 34, an increase in the turning force $F_t$ is transmitted through the first and second pivot pins 32, 34 to cause a concomitant increase in the locking forces $F_U$, $F_D$, thereby causing the wrench head assembly 30 to act in a self-camming or self-tightening manner.

The three-surface wrench 10 is ratchetable in that the wrench head assembly 30 may be repositioned with respect to the captured nut for the further application of turning forces. A ratcheting force $F_r$ is applied to the handle assembly 12 in an opposite direction from that of the engaging force $F_t$ as illustrated in FIG. 1A.

The ratcheting force $F_r$ applied to the handle assembly 12 causes the hook member 60 to be rotated about the second pivot pin 34 against the force exerted by the biasing spring 26 so that the wrench head assembly 30 rotates about the nut in the direction opposite the applied torque. After the wrench head assembly 30 has been rotated approximately 60 degrees, or multiples thereof, the biasing spring 26 causes the hook member 60 to snap over a corner of the nut N, thereby effecting recapture of the nut N. The snapping of the hook member 60 over the corner of the nut N produces an audible click as disclosed hereinabove.

Removal of the multi-surface wrench 10 can be accomplished in various ways. In the overwhelming number of applications, including pipe and tubing uses, the wrench 10 may be simply removed from the nut in an axial direction. If the wrench 10 cannot be slid off in an axial direction, a small applied force may be required to pull the wrench 10 free. Alternatively, the wrench head assembly 30 may be opened manually to remove the wrench 10.

Reactive forces $F_R$ are exerted by the nut N against the contacting surfaces 48, 50, 68 of the wrench head assembly 30 in response to resulting torqueing action.

One important design consideration for the three-surface wrench 10 of the present invention is that the second pivot pin 34 must be located on or near a downward projection of the locking force $F_D$. Preferably, the second pivot pin 34 is located to the left of the downward projection as viewed in FIG. 3A. This design constraint must be satisfied for all of the nut sizes within the predetermined range of the three-surface wrench 10. This constraint ignores sliding friction at the engaging surface 68 of the hook member 60, a conservative assumption.

For the following analysis, it is assumed that the respective locking and reactive forces are unitary force vectors as shown in FIG. 3A. It will be appreciated, however, that the locking and reactive forces may be distributed over the contacting surfaces 48, 50, 68 of the wrench head assembly 30 and the faces $N_1$, $N_2$, $N_3$ of the nut N, respectively.

Figure 4:
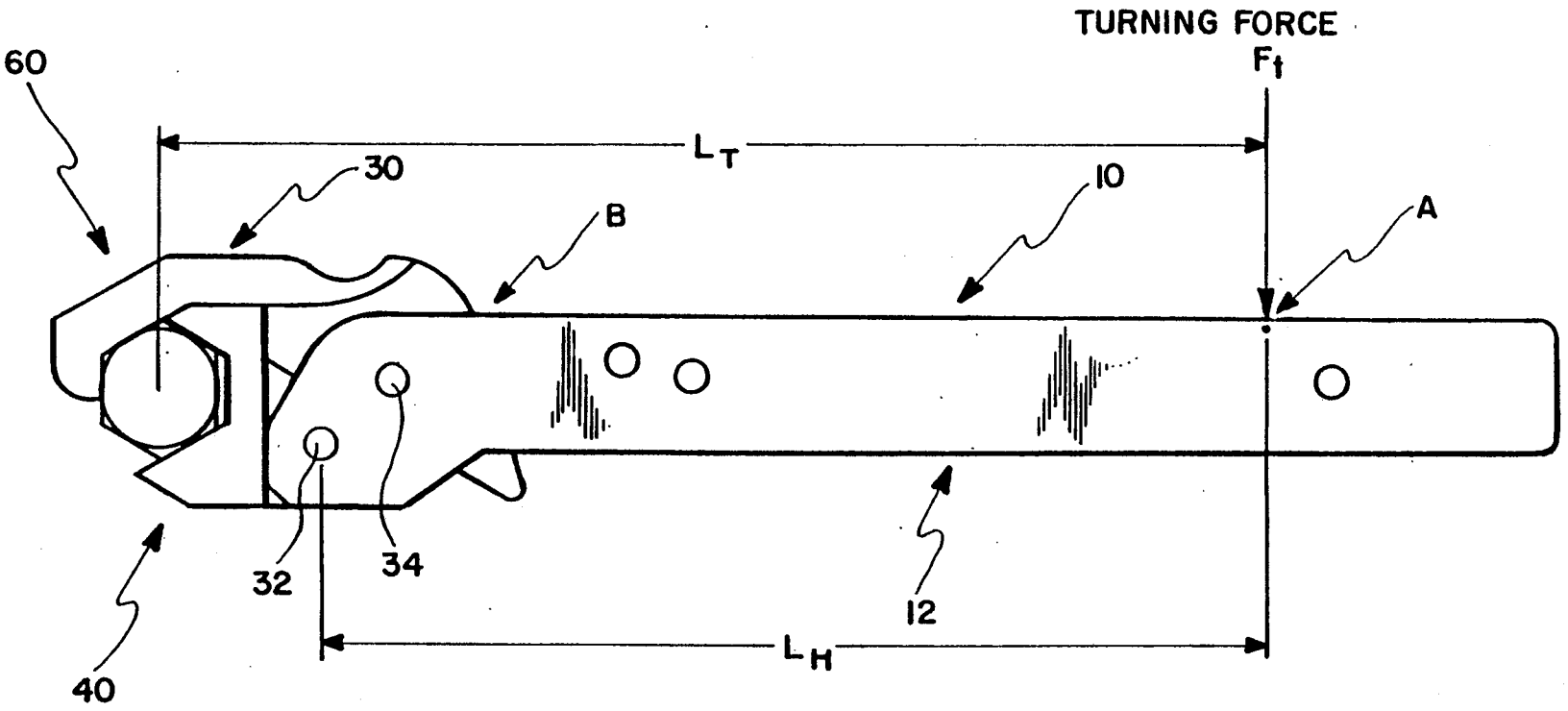
FIG. 4 is a plan view of the three-surface wrench of FIG. 1 depicting selected parameters thereof.

Referring to FIG. 4, two parameters for the three-surface wrench 10 are defined. A first length $L_T$ is the distance between the point of application A of the turning force $F_t$ to the handle assembly 12 and the center o the nut N. It is assumed that the force $F_t$ is applied at a single point A on the handle assembly 12 and further that the force $F_t$ is applied to the handle assembly 12 perpendicular thereto. A second length $L_H$ is the distance between the applied force $F_t$ and the first pivot pin 32.

As the turning force $F_t$ applied to the handle assembly 12 is moved from the point A towards a point B near the wrench head assembly 30, the ratio of $L_H/L_T$ is reduced. In the limiting case when the force $F_t$ is applied at point B, the ratio $L_H/L_T$ for the wrench of FIG. 4 becomes approximately 0.625. This low value requires considerable care in the design of the multi-surface wrench.

The length ratio $L_H/L_T$ for any particular point between A and B is also a function of the nut size that is captured. This fact arises from the change in orientation of the handle assembly 12 with respect to the wrench head assembly 30 for different nut widths, as exemplarily illustrated in FIGS. 2A, 2B, 2C.

The ratio of $L_H/L_T$ for the smallest sized nut within the predetermined range as shown in FIG. 2C is essentially unity. The ratios for the larger nuts illustrated in FIGS. 2B, 2C are greater than unity. Prudent design, however, dictates the use of the unity value.

Referring to FIG. 3A, two additional parameters are defined, S and $\theta$. The first and second pivot pins 32, 34 are spaced apart by a predetermined distance S. A reference line 38 extends outwardly from the first pivot pin 32. The reference line 38 is perpendicular to the upward force $F_U$ transmitted through the first pivot pin 32. Since the downward force $F_D$ is equal and parallel to the upward force $F_U$, a projection from the center of the second pivot pin 34 may be drawn to intersect the reference line 38, thereby forming a right angle triangle with a line between the centers of the first and second pivot pins 32, 34 defining the hypotenuse thereof. An angle $\theta$ is defined between the reference line 38 and the line between the centers of the first and second pivot pins 32, 34.

The following equations defining the configuration of the three-surface wrench 10 of the present invention may now be written.

$$F_D=(L_H/S_{eff})F_t \qquad \text{Eq. (1)}$$

wherein $S_{eff}$ is defined by:

$$S_{eff}=S(\cos\theta). \qquad \text{Eq. (2)}$$

The torque applied to the nut N is defined by:

$$T=F_t(L_T). \qquad \text{Eq. (3)}$$

The reactive torque applied to the wrench head assembly 30 by the nut N is defined by:

$$T_R=3F_R(A) \qquad \text{Eq. (4)}$$

wherein A is equal to one-half of the face width of the nut N having a width W. For the three-surface wrench 10 to remain locked or engaged on the nut N:

$$F_D>F_R \qquad \text{Eq. (5)}$$

$$S_{eff}<3A(L_H/L_T) \qquad \text{Eq. (6)}$$

where $A=(W/2)\tan(30)$, and $$S(\cos\theta)<0.866[L_H/L_T9W. \qquad \text{Eq. (7)}$$

There is no unique solution satisfying all of the design criteria equations set forth hereinabove. Additional input such as the predetermined range of the three-surface wrench 10, the maximum torque to be applied to a particular nut, and the type of material used to fabricate the three-surface wrench 10 must be specified.

One important consideration in designing the three-surface wrench 10 is to provide unconditional stability of the wrench. Instability occurs if the wrench head assembly 30 experiences rotational slippage with respect to the captured nut N. In many prior art wrenches, there is a tendency for the wrench head assembly to unlock when a turning force is applied to the handle assembly in the proximity of the wrench head assembly, i.e., near point B of FIG. 4.

Unconditional stability defines a minimum value of $S_{eff}$ for the corresponding value of the ratio of $L_H/L_T$. These values are a function of the width W of the nut N, and generally are most critical for the smallest sized nut of the predetermined range.

Figure 5:
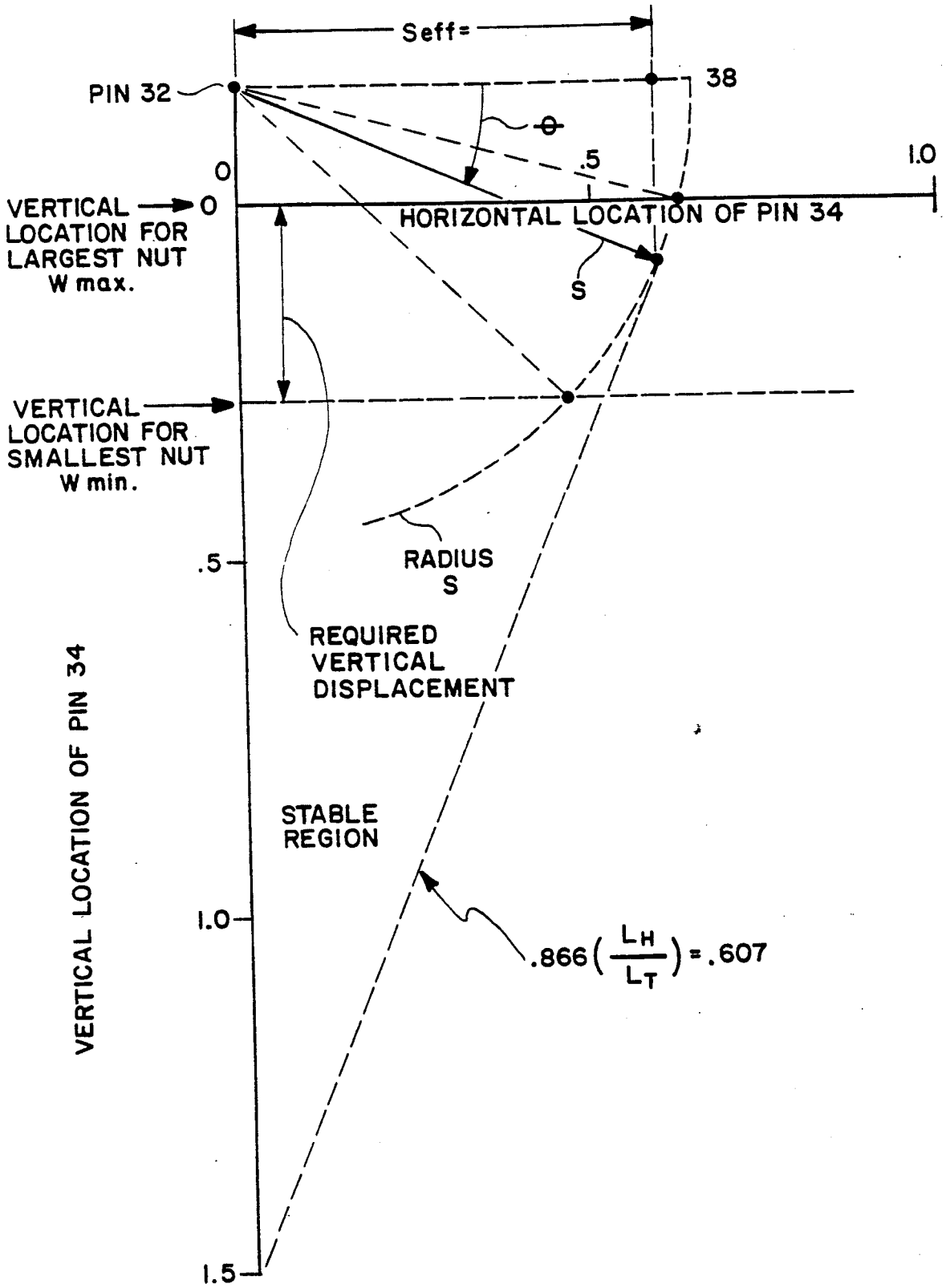
FIG. 5 is a graph representing the interrelationship of design constraints for the three-surface wrenches of FIGS. 1–3.

A graphical illustration of some of the interrelationships of the terms of Eq. (7) is presented in FIG. 5. The abscissa of FIG. 5 is the horizontal location of the second pivot pin 34. The ordinate of FIG. 5 is the vertical location of the second pivot pin 34. The required displacement of the hook member 60 is 1.5 times the difference between $W_{min}$ and $W_{max}$, i.e., the predetermined range of the wrench 10. The numerical factor 1.5 arises from the geometry of the nested hexagonals.

The radius S of the arc is the predetermined spacing between the first and second pivot pins 32, 34 and the angle $\theta$ is the angle of the arc. By way of illustration only, the dashed line represents the locus required if the product $0.866[L_H/L_T]$ is equal to 0.607. As long as the value of $S_{eff}$ remains to the left of the line having a slope of 0.607, the inequality of Eq. (7) will be satisfied and the wrench of FIG. 3A will be stable.

A representative three-surface wrench 10 according to the present invention has been designed and fabricated with a predetermined range of 1.22 and the capability to capture and torque a nut having a $W_{max}$ of 0.820 inches. This three-surface wrench 10 is capable of applying a torque of approximately 80 foot-pounds.

Three-surface wrenches 10 having a perpendicular handle assembly 12 as shown in FIGS. 2A–C can be designed with a larger value of S than three-surface wrenches having an in-line handle assembly 12 as shown in FIG. 1A. A greater value of S permits the three-surface wrench 10 to be designed to have a greater predetermined range, or alternatively a smaller angle of rotation of the handle assembly 12 for a predetermined range than corresponding three-surface wrenches having an in-line handle assembly.

The two confronting surfaces 54, 70 of the body and hook members 40, 60, respectively, play a significant role in the behavior of the three-surface wrench 10. As shown in FIG. 3A, the surface 54 consists of two straight segments 54*a*, 54*b* joined at an arcuate junction. The surface 70 consists of three straight segments 70*a*, 70*b*, 70*c* joined at respective arcuate junctions. The surfaces 54*a*, 70*a*, 70*b* contact each other for wrench openings 36 of width $W_{min}$ and $W_{max}$. Since $W_{max}$ defines a numerical value greater than the width of the largest nut in the predetermined range of the three-surface wrench 10, and $W_{min}$ defines a numerical value less than the width of the smallest nut in the predetermined range of the three-surface wrench, the fact that the confronting surfaces 54*a*, 70*a*, 70*b* contact each other when the width of the nut engaged by the wrench is equal to $W_{max}$ or $W_{min}$ does not affect the self-camming operation of the three-surface wrench 10 for nuts within the predetermined range.

For any nut having a width less than $W_{max}$ and greater than $W_{min}$, that is, within the predetermined range of the three-surface wrench 10, the confronting surfaces 54*a*, 70*a*, 70*b* do not contact each other with such nut engaged by the contacting surfaces 48, 50, 68 of the body and hook members 40, 60 respectively. The increasing gap between surfaces 54*b*, 70*c* is very important in the ratcheting action and the capturing action for nuts having widths near or equal to $W_{max}$.

During capture and ratcheting operations, this increasing gap allows the hook member 60 to be rotated further away from the body member 40 than the handle assembly 12 would permit. Without this design feature, the acoustic feedback signal would not be generated for nut having widths near or equal to $W_{max}$. It should also be self evident that the two tang portions 44, 64, whose geometry is determined in part by the confronting surfaces 54, 70, are important to the strength of the wrench 10.

Figure 3B:
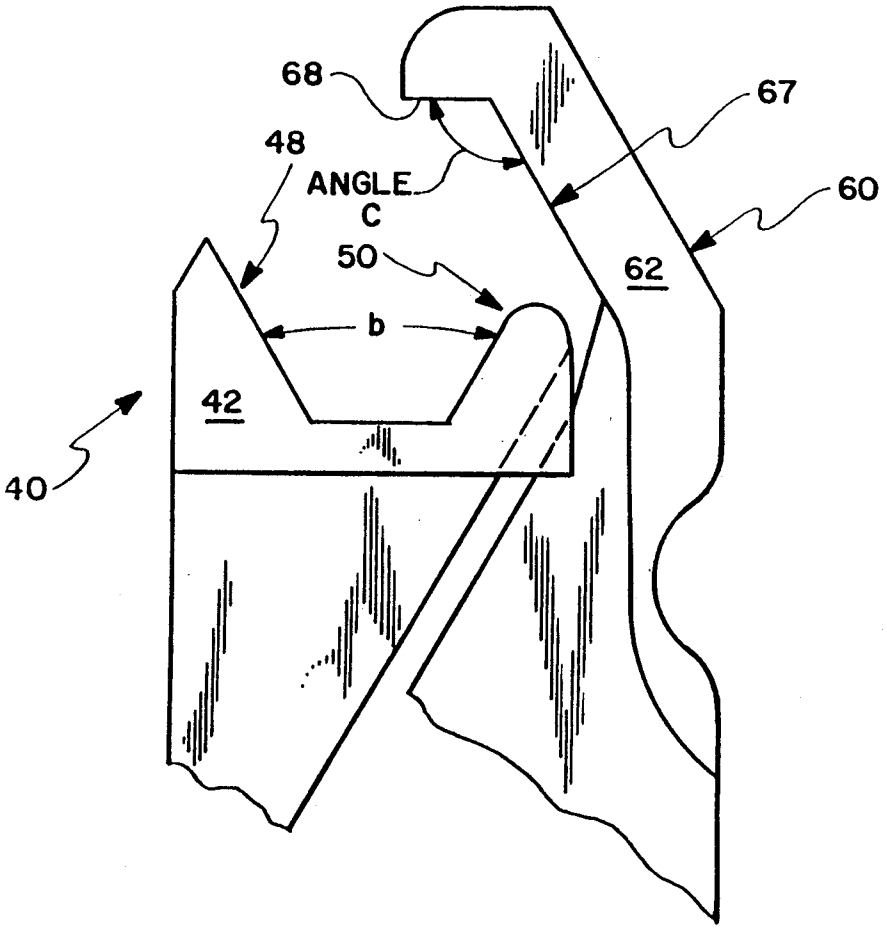
FIG. 3B is an alternative embodiment of the wrench head assembly of a three-surface wrench.

Several possible modifications in the design of the body and hook members 40, 60 of the three-surface wrench 10 are illustrated in FIG. 3B. The included angle b between the first and second contacting surfaces 48, 50 may be formed to be slightly more than 60 degrees. The contacting surface 50 may be formed with a slight curvature and a smoothly rounded tip. The included angle c between the contacting surface 68 of the hook member 60 and a contiguous surface 67 may be slightly more than 120 degrees and the tip of contacting surface 68 may be smoothly rounded.

Inclusion of one or more of these design modifications results in larger dimensional tolerances, improves the ratcheting action, and ensures proper seating of the nut. These modifications can be effected without significantly changing the mechanical strength of the three-surface wrench 10.

Figure 6:
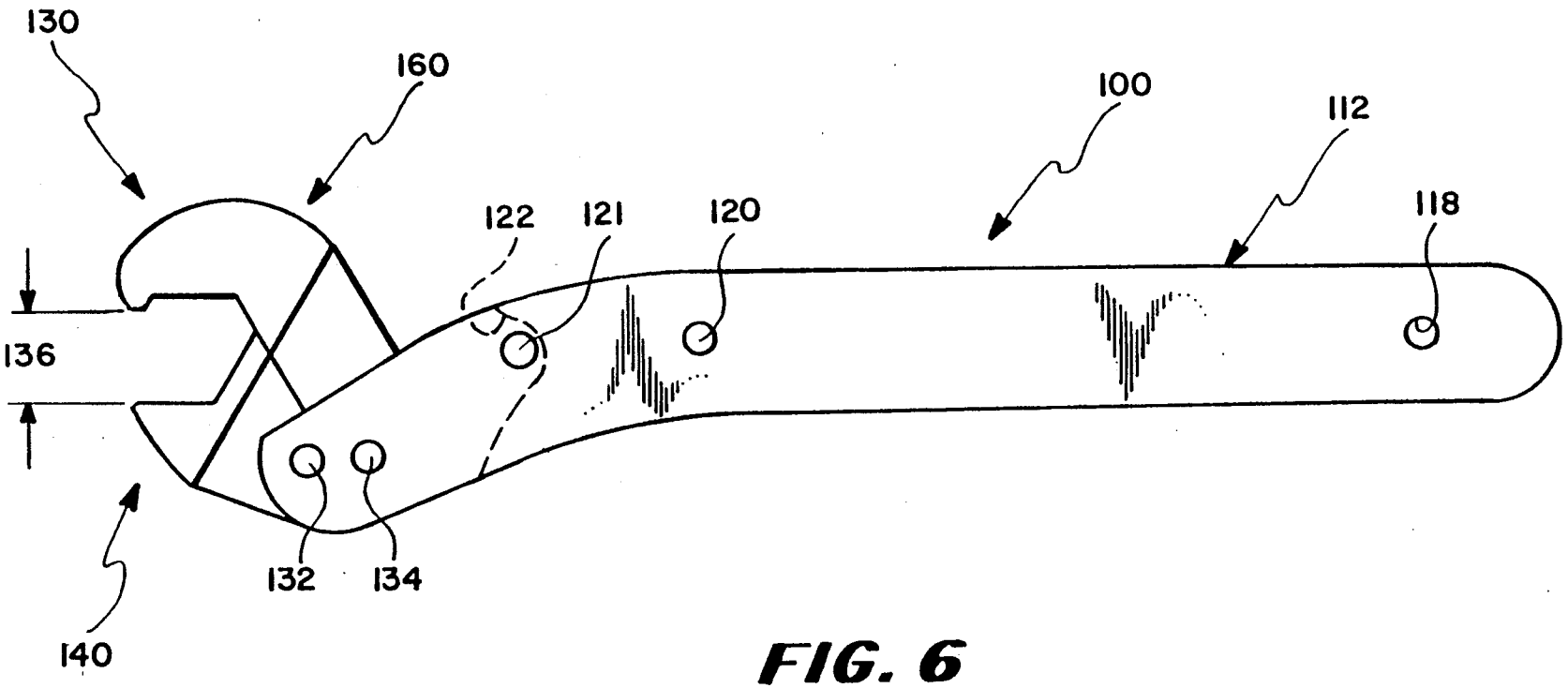
FIG. 6 is a plan view of a four-surface wrench.

A four-surface wrench 100 according to the present invention is illustrated in FIG. 6. The four-surface wrench 100 includes a handle assembly 112 and a wrench head assembly 130 rotatably attached thereto.

The exemplary handle assembly 112 includes external members 114, 114 and a spacing member 116 interposed therebetween. The handle assembly 112 further includes holes 118, assembly pins 120, 121, a wrench head assembly slot 122, a spring receiving slot 124 and a biasing spring 126 as disclosed hereinabove for the three-surface wrench 10.

Figure 7:
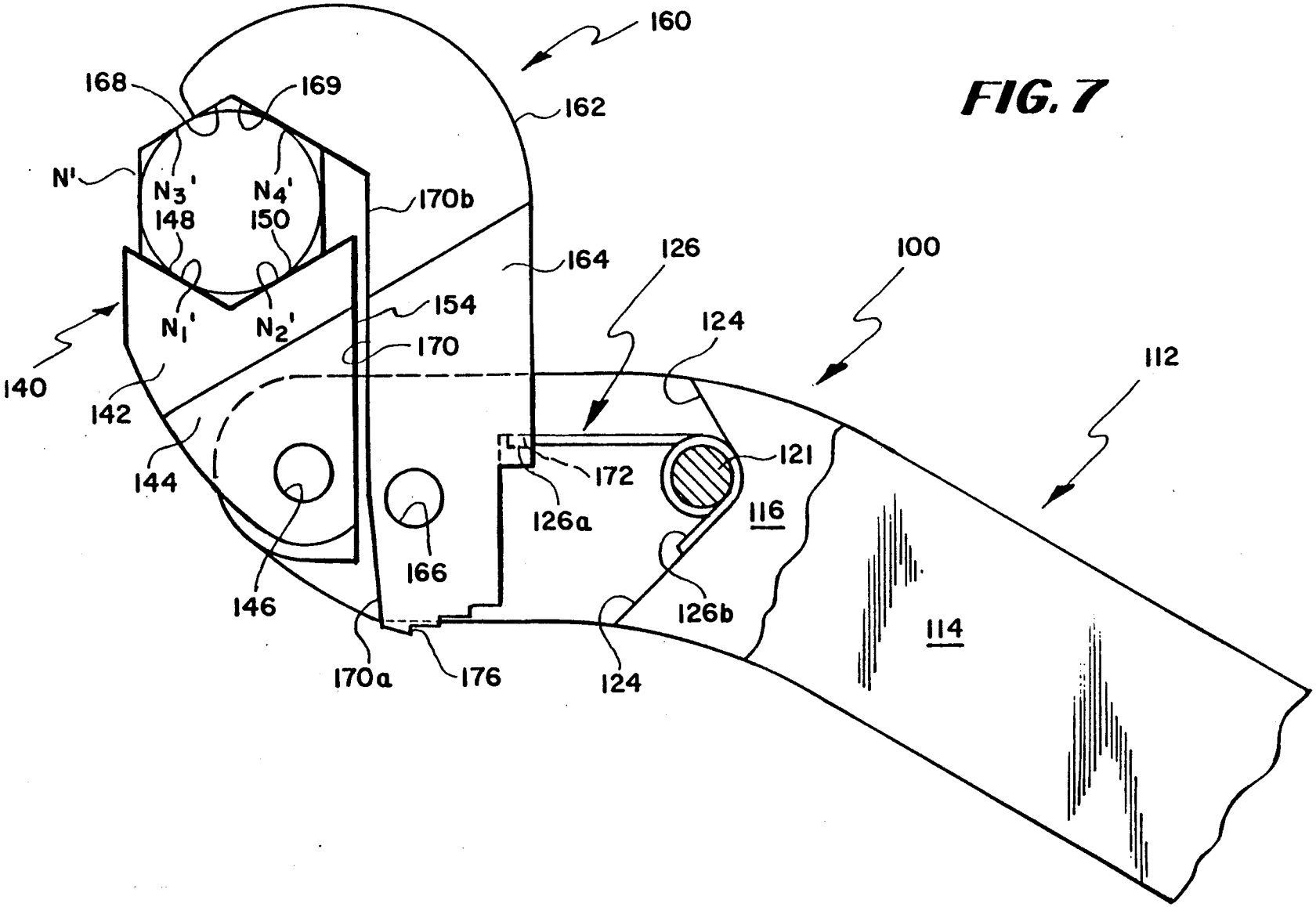
FIG. 7 is a partial sectional view of the four-surface wrench of FIG. 6 for the smallest sized nut of its predetermined range.

As exemplarily illustrated in FIG. 7, the wrench head assembly 130 includes a body member 140 having a jaw portion 142, a tang portion 144, a pivot hole 146 and a confronting surface 154, and a hook member 160 having a jaw portion 162, a tang portion 164, a pivot hole 166, a confronting surface 170, and a surface 172 for contacting one arm of the biasing spring 126. Optionally, the hook member 160 may include a finger depression 174 formed in the jaw portion 162 and/or a thumb projection 176 formed on the tang portion 164 to extend outwardly beyond the handle assembly 112 for manual opening of the wrench head assembly 130. The body member 140 is pivotally attached to the handle assembly 112 by means of a first pivot pin 132 and the hook member 160 is pivotally attached to the handle assembly 112 by means of a second pivot pin 134.

The jaw portion 142 includes a first contacting surface 148 and a second contacting surface 150. Unlike the first and second contacting surfaces 48, 50 of the three-surface wrench 10, the first contacting surface 148 of the four-surface wrench 100 is contiguous to the second contacting surface 150.

The jaw portion 162 of the hook member 160 includes a first contacting surface 168. The jaw portion 162 further includes a second contacting surface 169 contiguous with the first contacting surface 168. The wrench head assembly 130 of the four-surface wrench 100 contacts four corresponding surfaces or faces of a nut N'. The first and second surfaces 148, 150 of the body member 140 contact adjacent faces $N'_1$, $N'_2$, respectively, of the nut N'. The first and second surfaces 168, 169 of the hook member 160 contact adjacent nut faces $N'_3$, $N'_4$, respectively, of the nut N'.

As with the three-surface wrench 10, an important design consideration for the four-surface wrench 100 is that the second pivot pin 134 of the four-surface wrench 100 be located on or near a downward projection of the locking force exerted through the contacting surface 168. Preferably, the second pivot pin 134 should be located leftwardly of the downward projection as viewed in FIG. 7.

As a comparison of FIGS. 3A and 7 makes evident, the geometry of the wrench head assembly 130 of the four-surface wrench 100 is different from the wrench head assembly 30 of the three-surface wrench 10. Due to the difference in geometry, the design constraints of the four-surface wrench 100 are somewhat different than the design constraints for the three-surface wrench 10 as set forth above in equations (1)–(7). From the geometry of the nested hexagonals, it can be shown that the required vertical displacement of the second pivot pin 134 to accommodate a predetermined range is equal to 1.154 times the difference between $W_{max}$ and $W_{min}$ of the wrench 100. This is in contrast to the factor 1.5 for the three-surface wrench 10.

The expression for maximum spacing S between the first and second pivot pins 132, 134 is derived in a similar manner as hereinabove disclosed, and is given by:

$$S(\cos\theta) < 0.667[L_H/L_T]W \quad \text{Eq. (8)}$$

The spacing S between the first and second pivot pins 132, 134 is smaller than the spacing S between the first and second pins 32, 34 of the three-surface wrench 10. However, the four-surface wrench 100 is simpler in design and has a smaller profile than a three-surface wrench 10 having an equal range.

The four-surface wrench 100 of FIG. 7 has been designed so that the location of the first and second pivot pins 132, 134 facilitates the manufacture of the four-surface wrench 100 and such that the interactive confronting surface 154 of the body member 140 and the interactive confronting surface 170 of the hook member 160 are very simple and essentially straight. With this design, the two surfaces 154, 170 are in contact along almost their entire lengths for both $W_{min}$ and $W_{max}$. The confronting surfaces 154, 170 do not contact each other for any nut within the predetermined range of the four-surface wrench 100 captured by the wrench head assembly 130. The four-surface wrench 100 is self-camming or self-tightening in the same manner as described hereinabove for the three-surface wrench 10. As shown in FIG. 7, a portion 170*a* of the surface 170 is angled away from the confronting surface 154, the angling starting at a horizontal projection from the second pivot pin 134. This design feature permits capture and ratcheting in the same manner as described hereinabove for the three-surface wrench 10. There are several alternative methods of achieving this same result.

Figure 8:
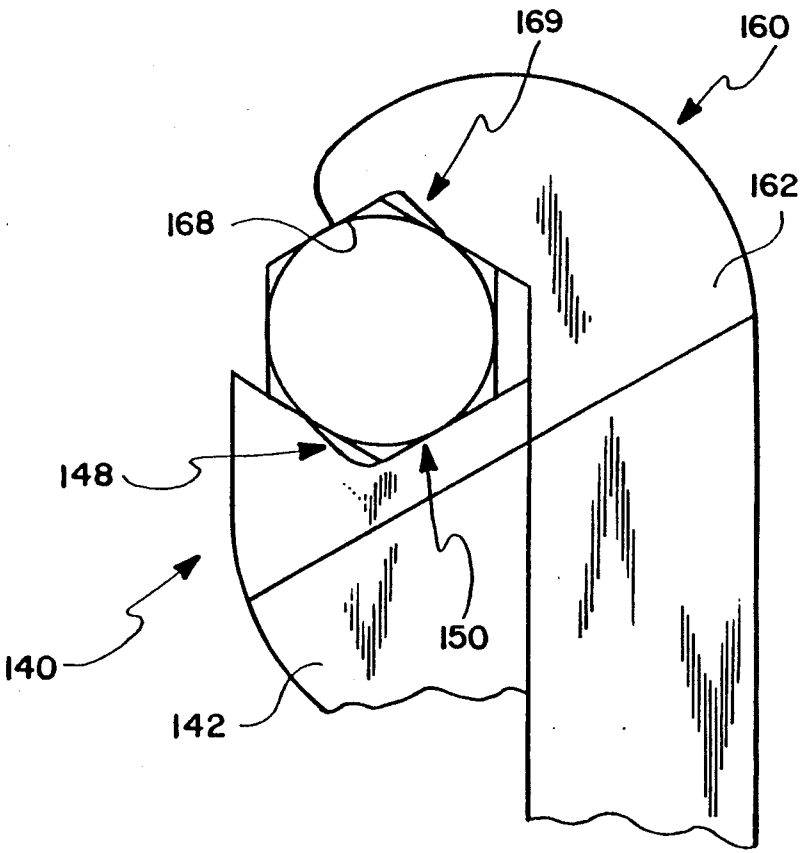
FIG. 8 is an alternative embodiment of the wrench head assembly of a four-surface wrench.

Several possible modifications in the design of the body and hook members 140, 160 are illustrated in FIG. 8. First, the contacting surface 148 of the body member 140 and the contacting surface 169 of the hook member 160 may be formed as smooth curves near the junction with the second surfaces. This modification permits easier ratcheting and simplifies the manufacturing process. The included angle between the contiguous contacting surfaces 148 and 150 of the body member 140 and the contacting surfaces 168 and 169 of the hook member 160 can be slightly less than 120 degrees. The second contacting surface 150 of the body member 140 may be slightly rounded. If the predetermined range of the four-surface wrench 100 is small, this modification can be easily accomplished.

The four-surface wrench 100 functions in substantially the same manner as the three-surface wrench 10 to automatically capture a range of different sized nuts. Likewise, the four-surface wrench 100 is self-camming or self-tightening when subjected to a turning force and is ratchetable when subjected to a ratcheting force in the same manner as disclosed hereinabove for the three-surface wrench 10.

Figure 9:
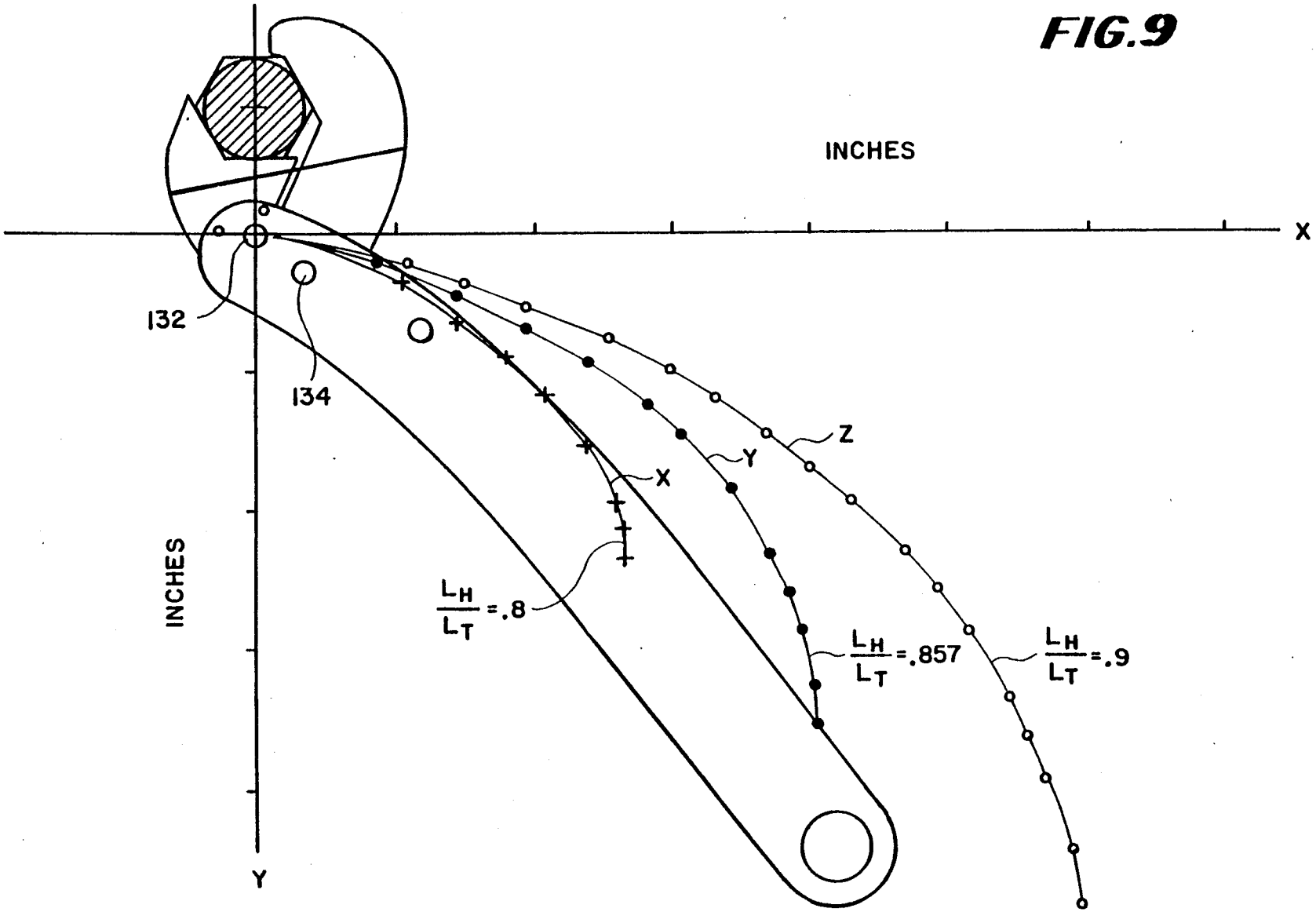
FIG. 9 is a graphical depiction of possible handle configurations for the four-surface wrench of FIG. 6.

Since the spacing S of a four-surface wrench is less than the spacing S of a three-surface wrench for the same predetermined useful range, it is helpful to illustrate alternative handle assembly designs. During normal usage the turning force will be applied near the end of the handle. However, there are some applications such as a backup wrench in a restricted space where the handle assembly may be contacted by a fixed member. Furthermore, the "feel" of the four-surface wrench is significant to the operator. Four-surface wrenches with high stability have a much better "feel" to an operator. A graphical representation of exemplary designs is illustrated in FIG. 9.

A four-surface wrench of known design is illustrated together with three different computer-generated curves labeled X, Y and Z. Each individual curve represents a handle assembly design having a different spacing S and which will achieve unconditional stability with a selected value of $L_H/L_T$. For a four-surface wrench to have unconditional stability, the slope of the handle assembly at any given point where the turning force is applied must be less than the corresponding slope on a particular curve (X, Y or Z). The four-surface wrench illustrated in FIG. 9 has a handle assembly based upon curve X.

Four-surface wrenches 100 have been designed and fabricated with a predetermined range of 1.33. The curved handle assembly 112 as illustrated ensures unconditional stability. These four-surface wrenches are capable of capturing and torqueing nuts within the range from 0.620 inches to 0.830 inches. This range encompasses eleven standard nut sizes, including five standard American nut sizes and six metric nut sizes.

Several of these wrenches have been made of mild steel and hardened. These four-surface wrenches have been tested and demonstrate the capability of achieving torques in excess of 100 foot-pounds on grade 6 hardened nuts and bolts without any measurable change in the critical dimensions of the wrenches.

A set of three four-surface wrenches, each having a predetermined range, is sufficient to cover the entire range of nut sizes commonly encountered by one of ordinary skill in the art and/or the ordinary consumer.

A variety of modifications and variations of the present invention are possible in light of the above teachings. It is therefore to be understood that within the scope of the appended claims, the present invention may be practiced otherwise than as specifically described hereinabove.

What is claimed is:

1. A multi-surface wrench operative on a plurality of standard nuts of different sizes, comprising:

a wrench head assembly including a body member having first and second contacting surfaces and a confronting surface having a predetermined configuration, and a hook member having at least one contacting surface and not more than two contacting surfaces and a confronting surface having a predetermined configuration complementary to portions of said predetermined configuration of said confronting surface of said body member, said first contacting surface and said second contacting surface of said body member and said at least one contacting surface of said hook member in combination defining a wrench opening for said wrench head assembly;

a handle assembly including spring means for exerting a biasing force against said hook member; and means for pivotally coupling said wrench head assembly to said handle assembly, said pivotal coupling means including a first pivot pin for pivotally coupling said body member to said handle assembly, and a second pivot pin for pivotally coupling said hook member to said handle assembly, said body and hook members being pivotally coupled to said handle assembly with said confronting surfaces thereof disposed in opposed relation;

said opposed confronting surfaces of said body and hook members having a gap therebetween for any nut within said predetermined range captured by said contacting surfaces of said body and hook members such that said disposition of said confronting surfaces of said body and hook members in combination defines a predetermined range for said multi-surface wrench, said predetermined range having a maximum nut width and a minimum nut width that encompasses the plurality of standard nuts of different sizes that may be operated on by said multi-surface wrench and wherein portions of said confronting surfaces of said body and hook members are in contact with each other only when said contacting surfaces are disposed apart at a width greater than the maximum nut width or a width less than the minimum nut width;

said hook member being pivotable about said second pivot pin against said biasing force in response to a capture force applied to said handle assembly to enlarge said wrench opening wherein any nut within the said predetermined range may be captured by said wrench head assembly, said biasing force causing said hook member to pivot so that said contacting surfaces of said body and hook members engage the captured nut;

said hook member being pivotable about said second pivot pin against said biasing force in response to a ratchet force applied to said handle assembly to ratchet with respect to the captured nut through a predetermined ratchet angle, said biasing force causing said hook member to pivot so that said contacting surfaces of said body and hook members reengage the captured nut.

2. The multi-surface wrench of claim 1 wherein said multi-surface wrench is a three-surface wrench comprising said body member having said first and second contacting surfaces and said hook member having one contacting surface.

3. The multi-surface wrench of claim 2 wherein contacting surfaces of said three-surface wrench are spaced apart approximately 120 degrees from one another.

4. The multi-surface wrench of claim 1 wherein said multi-surface wrench is a four-surface wrench comprising said body member having said first and second contacting surfaces and said hook member having two contacting surfaces.

5. The multi-surface wrench of claim 4 wherein said first and second contacting surfaces of said body member and said two contacting surfaces of said hook member, respectively, are contiguous.

6. The multi-surface wrench of claim 1 wherein said spring means is mounted in said handle assembly and includes a first arm engaging said handle assembly and a second arm engaging said hook member.

7. The multi-surface wrench of claim 1 further comprising means formed as part of said hook member for manually pivoting said hook member about said second pivot pin against said biasing force to enlarge said wrench opening of said wrench head assembly.

* * * * *

UNITED STATES PATENT AND TRADEMARK OFFICE

CERTIFICATE OF CORRECTION

PATENT NO. : 5,050,464

DATED : September 24, 1991

INVENTOR(S) : Carl R. Hurtig

It is certified that error appears in the above-identified patent and that said Letters Patent is hereby corrected as shown below:

In the Abstract, line 7, "assebmly" should read --assembly--.

Column 7, line 22, "center o the nut" should read --center of the nut--.

Column 8, line 23, "S(cos θ)<0.866[$L_H/L_T$9W." should read -- S(cos θ)<.866{$L_H/L_T$}W. --.

Signed and Sealed this

Second Day of August, 1994

Attest:

Bruce Lehman

BRUCE LEHMAN

Attesting Officer

Commissioner of Patents and Trademarks